United States Patent [19]

Hellström

[11] 4,362,222

[45] Dec. 7, 1982

[54] ARRANGEMENT FOR DAMPING AND ABSORPTION OF SOUND IN ROOMS

[75] Inventor: Per A. Hellström, Gothenburg, Sweden

[73] Assignee: Byggnadsfysik A & K AB, Gothenburg, Sweden

[21] Appl. No.: 250,254

[22] Filed: Apr. 2, 1981

[30] Foreign Application Priority Data

Apr. 9, 1980 [SE] Sweden ..... 8002653

[51] Int. Cl.[3] ..... E04B 1/82; E04B 1/99

[52] U.S. Cl. ..... 181/30; 181/287; 181/295

[58] Field of Search ..... 181/30, 198, 284, 287, 181/295, 286; 52/144–145

[56] References Cited

U.S. PATENT DOCUMENTS 2,020,430 11/1935 Oed ..... 181/284 X 2,224,651 12/1940 Jacobs ..... 181/30

FOREIGN PATENT DOCUMENTS 786503 9/1935 France ..... 181/30

OTHER PUBLICATIONS

Carson et al., "Broadcast Studio," *Architectual Forum*, Feb. 1946, pp. 98–100.

Rettinger, Scoring-Stage Design, *Journal of the Society of Motion Picture Engineers*, May 1938, pp. 519–534.

*Primary Examiner*—L. T. Hix

*Assistant Examiner*—Thomas H. Tarcza

*Attorney, Agent, or Firm*—Holman & Stern

[57] ABSTRACT

An acoustical system for damping and absorption of sound in rooms to provide a sound damping even at very low frequencies, e.g. 50 Hz, and simultaneously improve speech comprehension in the entire room by reduction of the resonance time. The acoustic absorption can be varied to vary the resonance time over the entire part of the frequency area. The sound absorbents 14 in the form of plates, mats or similar constructions, are arranged at an angle in at least one corner area 11 formed by the walls 12 and ceiling 13 of the room. In the corner area 11 behind the absorbent 14, an air volume is trapped so that the absorbent due to the sound influence has a membrane effect. The inclination and position of each absorbent 14 can be varied individually or in groups.

11 Claims, 10 Drawing Figures

ARRANGEMENT FOR DAMPING AND ABSORPTION OF SOUND IN ROOMS

FIELD OF THE INVENTION

The present invention relates to an acoustical system for damping and absorption of sound in rooms even at very low frequencies (50 Hz) as well as improvement of speech comprehension in the whole room by lowering the resonance time.

BACKGROUND OF THE INVENTION

It is often desired to lower the sound pressure level in rooms through absorption. In rooms where both speech and music occur, this absorption should preferably give the same resonance time over the entire range of frequencies area of interest and which can be from 50–5000 Hz. This is normally attempted by a combination of different materials with varying sound absorption coefficients in varying frequency intervals. Generally, two different types of sound absorbents are possible in this connection, namely those that are of porous material which are effective from a few hundred Hz and upward, or so called hard absorbents which give high absorption at low frequencies, but are not effective at high frequencies. The absorption coefficient for an absorbent with low resonance frequency is normally not high, which demands that large areas are covered with absorbents to lower the resonance time. To meet the demands on resonance time in rooms such as classrooms, and which may not exceed 0.6 seconds in valid frequency range, an additional absorption surface is needed, which generally covers the entire ceiling. This in its turn results in a very poor accoustic surrounding. Since it is the lowest frequency range that determines the size of the additional absorption surface area, it has been natural to try to increase actual absorption of the material in these frequency ranges.

It is known that porous absorbents of mineral wool or similar materials get an improved low frequency absorption if mounted as an inner ceiling with a distance to the existing ceiling. The distance decides to a large degree how far down in frequency that sound is effectively absorbed. With a distance of e.g. 30 cm a reasonably good absorption down to approximatly 300 Hz is achieved. There are however limits as to how low an inner ceiling can be mounted and for practical reasons lowering of absorption to below 250 Hz has not been possible. An absorbing inner ceiling gives maximum absorption at that frequency which coincides with a quarter wavelength between the absorbent and the existing ceiling.

It is also well known that a long resonance time negatively affects speech comprehension in rooms of different kinds and to lower resonance time acoustic absorbers of different kinds have been introduced. The most common method is still to cover all or part of a room's ceiling with absorbents. A complete inner ceiling however absorbs even the early reflections which are needed for speech comprehension in the rear of the room, whereas it is true that a partially covered inner ceiling with reflecting surfaces in the center, aids the early reflections to reach the rear of the room, but gives a poor absorption. Both these methods of arranging the sound absorbents have minimal absorption under 200 Hz.

BRIEF SUMMARY OF THE INVENTION

An object of the present invention is to provide a good low frequency absorption at the same time as resonance time is kept short, in for example auditoriums. Another object is to make it possible to vary the resonance time, which is advantageous in for example, concert halls, theaters, churches and similar rooms, where music, song and speech occur. In, churches, for example, it is preferable with a straight resonance time curve during the sermon to increase speech comprehension, i.e. relatively short resonance time, even in the lower frequency range, whereas during organ music a long resonance time is sought after in the lower frequency range. These objects have been achieved with the invention by the fact that sound absorbents in the form of plates, mats or similar constructions are arranged at an angle at at least one corner area formed by the walls and ceiling of the room so that the absorption surface of the sound absorbents is facing the interior of the room, and that in the corner area behind the absorbent there is an airspace so that the absorbents by the sound action will have a membrane effect.

The advantages of mounting accoustic absorbents diagonally between the wall and ceiling in a room are many. Firstly a good absorption in the frequency ranges under 300 Hz and even below 50 Hz is achieved. By choosing surface weight flow resistance and diagonal volume, maximum absorption can be adjusted to the frequency range desired in a specific room. Usage of the room's corners between wall and ceiling is especially important since sound pressure in the room is greatest within this area. By placing diagonal absorbents in these areas the sound pressures behind the absorbents are damped, which gives a high pressure difference over the absorbent. This difference results in high particle velocity in the air in the absorbent, which in turn results in great losses, ie. high absorption. The pressure difference also accelerates the absorption plate itself. The plate and the air volume trapped behind form a resonance system with one or more resonance frequencies.

DETAILED DESCRIPTION OF PREFERRED EMBODIMENTS

Figure 1:
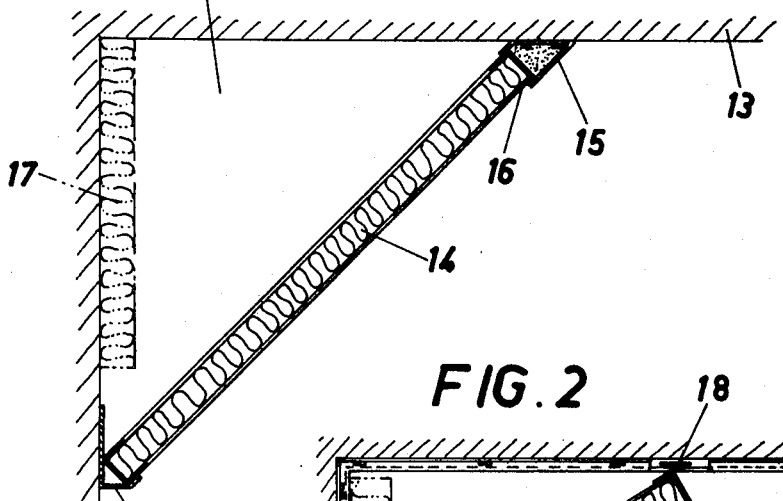
FIG. 1 shows a section through a corner area of a room with a fitted sound absorbent according to the invention.

On the drawings the numeral 11 denotes a corner section, formed between a wall 12 and a ceiling 13 of a room. A sound absorbent 14 in the form of an accoustic absorbing plate or panel, for example mineral wool, is placed diagonally between said wall 12 and ceiling 13, so that a volume of air is trapped behind the absorbent 14. The mineral wool plate is suitably along the outer edges surrounded by a frame 16 having a U-shaped cross-section that stiffens the plate. A number of absorbents 14, corresponding to the entire length of the room are supported by profiled metal holders 15, which are fastened to the wall 12 and the ceiling 13 and formed so that the absorbents can easily be put up or taken down. Suitably, such diagonal sound absorbents are arranged in the same room along two opposing corner areas. It can in certain cases be suitable to arrange an absorption plate 17 even inside the diagonal absorbent 14 as is shown in FIG. 1 with dash-dotted lines. The span of the sound absorbents are adapted to the size of the room and the field of application and for an ordinary classroom for about thirty pupils a span of 0.5 m has proved to be appropriate. To be able to vary the accoustic absorption and resonance time over a large frequency area or only a part thereof it is possible to change the angle of inclination of the absorbent 14 and/or its position, whereby the absorption peak can easily be moved on the frequency range. The different possibilities to vary the absorbents position or angle is shown in FIGS. 2–8.

Figure 2:
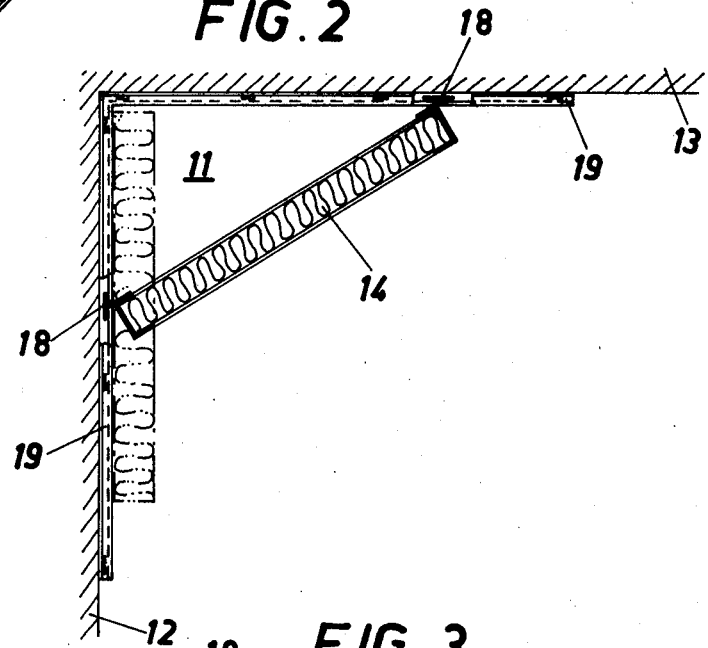
FIG. 2–8 show sections through corner areas of a room illustrating different positions and/or inclinations of adjustable sound absorbents according to the invention.

FIG. 2 shows an absorbent 14, which on its ends facing the wall 12 and ceiling 13, respectively, are constructed with guiding means 18, which cooperate with guides 19 arranged along the wall and ceiling respectively. The guides have such a length, that the absorbent 14 can take every possible position from a position parallel to the wall to a position parallel to the ceiling.

Figure 3:
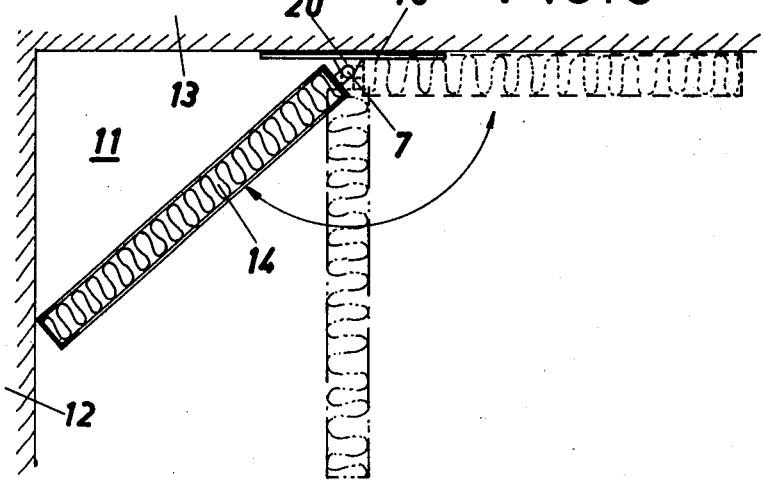

FIG. 3 shows an embodiment where the absorbent 14 along its one edge is moveably suspended in bearing means 20 in the ceiling 13 or possibly at the wall 12. When the bearing means 20 is suspended from the ceiling the absorbent can either be used as a diagonal absorbent according to the invention, as a baffle in a vertical hanging position or as a standard sound absorption unit in a position parallel to the ceiling. Even the bearing means 20 can be adjustable in the guide 18, so that the angle between the absorbent 14 and the wall 12 can vary.

Figure 4:
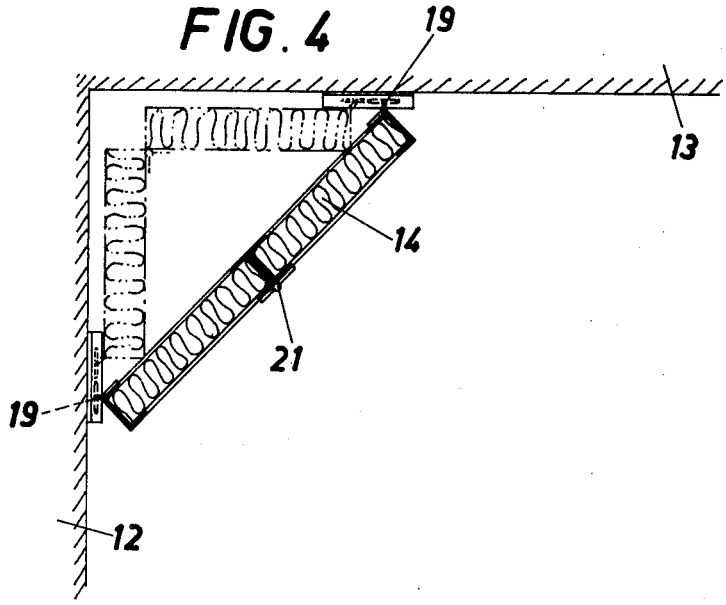

In the embodiment shown in FIG. 4 the absorbent 14 is divided in two and on the side facing the room a hinge 21 is attached in the joint. The outer edges of the absorbent are guided in guides 19, so that the divided absorbent can be folded until the two parts are substantially parallel to, or in contact with, the wall 12 and the ceiling 13, as is shown by dash-dotted lines.

Figure 5:
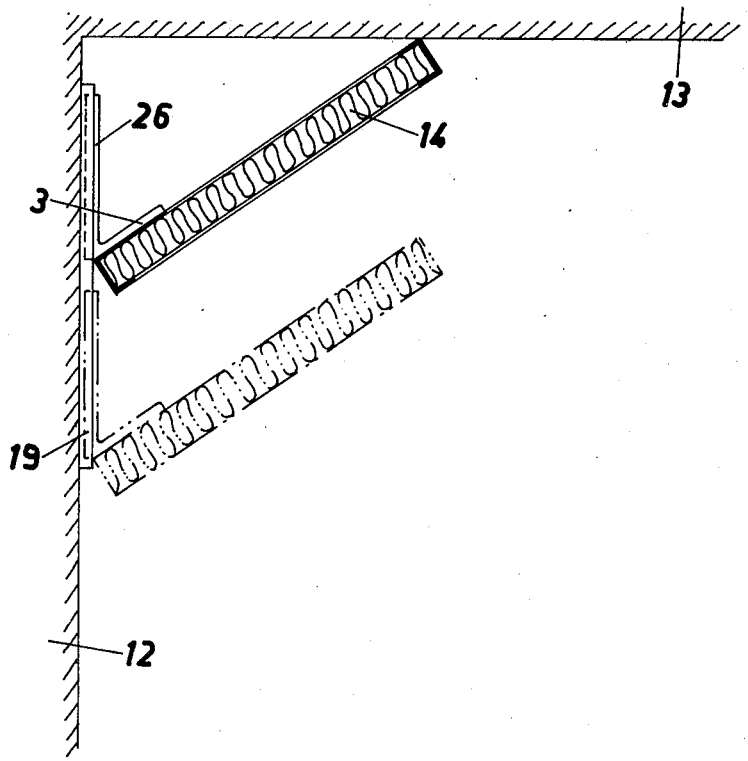

In the embodiment according to FIG. 5 the angle that the absorbent 14 makes with the wall 12 can not be changed, but the absorbent is adjustable in height along a guide 19.

Figure 6:
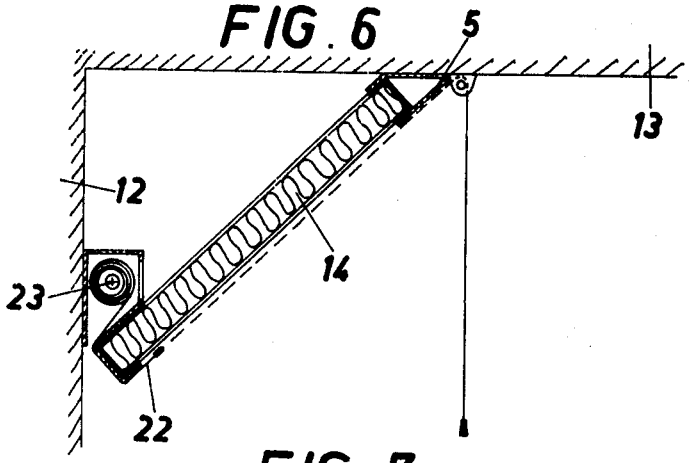
Figure 7:
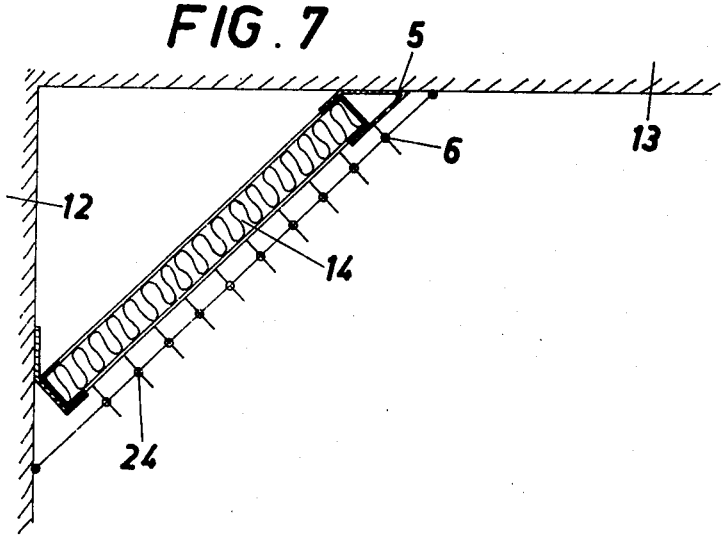

In those cases where a quick change of the qualities of the absorbent is desired, any of the arrangements shown in FIGS. 6 or 7 can be used.

In FIG. 6 is shown a fixed absorbent 14 between wall 12 and ceiling 13, on one surface of which, preferably the one facing the room, a reflector 22 can be attached, which in this embodiment consists of a rolling shutter 23 of an acoustic hard material. The covering of the outer face of the absorbent by the reflector 22 can easily be adjusted according to circumstances or needs either manually as with a draw string as shown, or with the assistance of small electric motors.

A similar effect as with the embodiment according to FIG. 6 is achieved with the variant according to FIG. 7 where in front of the absorbent 14 a louvered blind, such as a venetian blind 24 or similar type of reflector, is placed. With both of these constructions shown in FIGS. 6 and 7 it is possible with the reflector in active position to lower the high frequency absorption so that a long resonance time is obtained, which can be desireable e.g. in a service in a church during the sermon. During the organ music the reflectors are placed in an inactive position.

Figure 8:
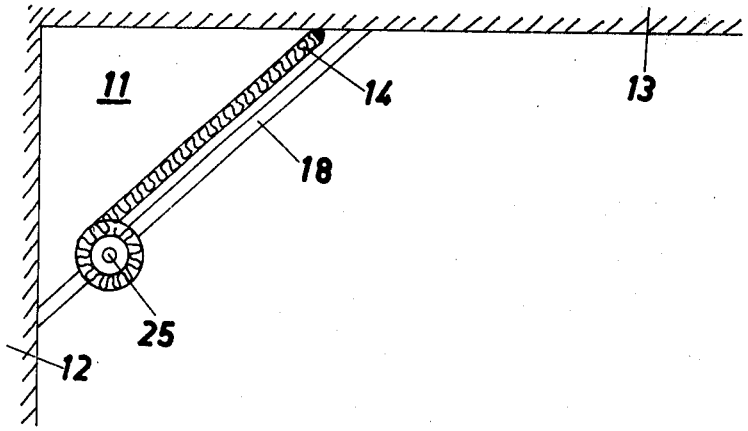

The embodiment according to FIG. 8 differs from the previous ones in that the absorbent 14 is in the form of a soft mat which is fixedly supported in a fastening at the ceiling 13, or walls 12, and at the other end is rolled up on a roller type apparatus 25 that is guided in a guide 18. By rolling up all or part of the absorbent 14 the low frequency absorption is removed.

Figure 9:
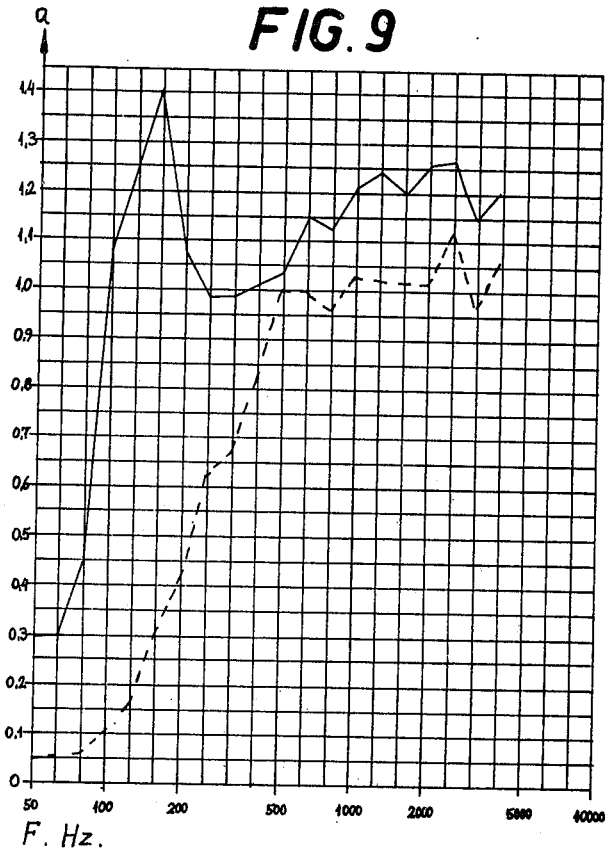
FIG. 9 shows a diagram of sound absorption measurements.

In the diagram in FIG. 9 a measurement curve on a diagonal absorbent according to the invention is shown by the continuous line and a corresponding measurement curve performed in the same room, but fitted with an inner ceiling covered with the same absorption material as the absorbent is shown by the dash line. In the diagram the ordinate axis denotes the absorption coefficient and the abcissa denotes the frequency in Hz. With a diagonal absorber according to the invention with a span of 0.6 m an absorption peak, i.e absorption coefficient of 1.4 at 160 Hz was achieved, while the same room with a conventionally formed ceiling with sound absorbents covering the ceiling completely achieved an absorption peak of 1.1 at 2500 Hz, and an absorption coefficient of 0.3 Hz at 160 Hz.

Figure 10:
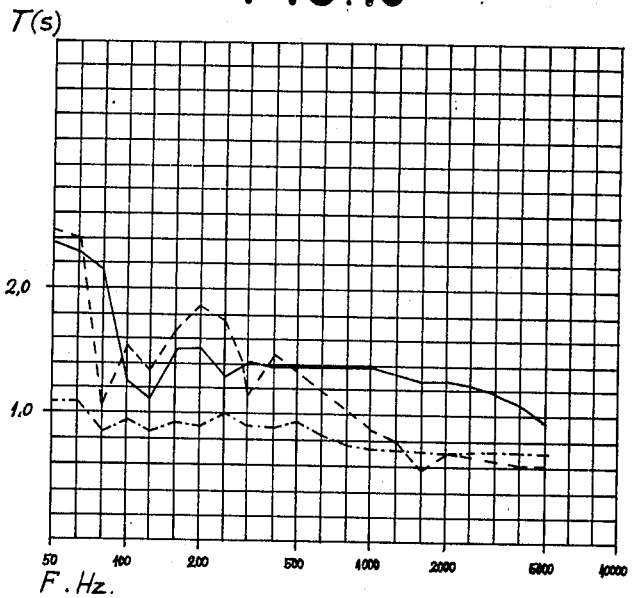
FIG. 10 shows a diagram of resonance time.

That such high absorption coefficients were achieved with usage of diagonal absorbents according to the invention can be explained by the fact that the absorbents 14 through their special fitting work as membranous absorbents. Behind the mineral wool plate 14 the sound pressure is very low whereas it is high in front of the absorbent. A relatively large acceleration pressure affects the plate, which results in a high pressure difference through the absorbent and large particle movements and thereby friction losses, i.e. high absorption. By the membrane movements these losses are increased and unusually high absorption coefficients are reached. The absorption peak through membrane action is dependant upon the materials flow resistance, its surface mass ($kg/m^2$) and rigidity. In one and the same material the rigidity varies with its length, i.e. span, and the trapped air volume, which can be changed by varying the inclination of the absorbent. To form an even resonance time as a function of the frequency of a room, span and inclination are therefore changed. In the diagram according to FIG. 10, measurements of resonance time (Ts) for three different cases in one and the same room are shown. On the ordinate axis of the diagram the resonance time is given, and on the abscissa the frequency in Hz. With a continuous line is shown a classroom in which no sound damping actions have been done. The dashed line curve shows the same classroom, but with an inner ceiling completely covered with sound absorbents. When the same classroom was then equipped with only diagonal absorbents according to the invention, the dash dotted line-curve was achieved showing that the resonance time, especially at low frequencies was reduced by more than half.

I claim:

1. An acoustical system for damping and absorbing sound in rooms even at very low frequencies as well as improving speech comprehension in the entire room by lowering the resonance time, comprising sound absorbents in the form of plates, panels, mats or the like are arranged in at least one corner area formed by the walls and ceiling of the room at an angle with respect to said walls and ceiling with the absorption surface of the sound absorbents facing the interior of the room so that an air volume is trapped in said corner area behind the absorbents and due to the sound influence the absorbents have a membrane effect.

2. An acoustical system according to claim 1, and further comprising means for adjustably mounting said absorbents so that the inclination of each absorbent is adjustable individually or in groups.

3. An acoustical system according to claim 2, wherein said adjustable mounting means comprises guide members mounted on at least one of the ceiling or wall and cooperating adjustable attachment means on the adjacent edge of each absorbent adapted so that the inclination of the absorbent is adjustable in optional positions between horizontal and vertical positions.

4. An acoustical system according to claim 2, wherein said adjustable mounting means comprises each absorbent is pivotably hinged at its edge adjacent the ceiling or the wall so that it is adjustable in different angular positions.

5. An acoustical system according to claim 2, wherein said adjustable mounting means comprises guide members mounted on said ceiling and said wall adjacent the respective edges of each absorbent, cooperating adjustable attachment means on said respective edges of each absorbent, each absorbent comprising two parts connected together by hinge means so that said absorbent is foldable around said hinge means into said corner in various positions.

6. An acoustical system according to claim 2, wherein said adjustable mounting means comprises a holder attached to one of the edges of the absorbent to hold it in a fixed or adjustable inclined position, and a guide member mounted on the respective ceiling or wall adjacent said holder, said holder being adjustable in said guide member.

7. An acoustical system according to claim 1 wherein an adjustable sound reflector means is provided in cooperative relationship with said absorbents to adjustably cover optional sections of the surfaces of at least one of the absorbents turned towards and/or away from the room.

8. An acoustical system according to claim 1, wherein at least some of said absorbents are each comprised of a flexible mat wound on a roller, said roller being adjustable along guide rails.

9. An acoustical system according to any one of claims 1–7, wherein each sound absorbent member is surrounded on its edges by a frame of U-shaped cross-section.

10. An acoustical system according to claim 7, wherein said reflector means comprises a flexible sheet member wound on a roller mounted adjacent one edge of each absorbent, and means to draw said reflector over said surface of said absorbent.

11. An acoustical system according to claim 7, wherein said reflector means comprises an adjustable louvered blind mounted adjacent the surface of said absorbent facing the room.

* * * * *